United States Patent [19]

Thaule

[11] 4,043,580

[45] Aug. 23, 1977

[54] CABLE-CONTROLLED GRAB DEVICE

[75] Inventor: Birger Hellmann Thaule, Risoy, Norway

[73] Assignee: A/S Kongshavn Industri, Alvoy, Norway

[21] Appl. No.: 697,215

[22] Filed: June 17, 1976

[30] Foreign Application Priority Data

June 20, 1975 Norway ..... 752193

[51] Int. Cl.[2] ..... B66C 3/10

[52] U.S. Cl. ..... 294/70; 37/186; 294/110 R; 294/111

[58] Field of Search ..... 294/70, 71, 83 R, 88, 294/106, 108, 109, 110 R, 111, 112; 37/183 R, 183 A, 184, 186, 187, 188; 214/147 G, 656, 657

[56] References Cited

U.S. PATENT DOCUMENTS

| | | | |
|---|---|---|---|
| 997,748 | 7/1911 | Callahan | 37/184 |
| 1,817,595 | 8/1931 | Wallace | 37/186 |
| 3,934,917 | 1/1976 | Paxton et al. | 294/70 |

FOREIGN PATENT DOCUMENTS

| | | | |
|---|---|---|---|
| 1,237,251 | 6/1960 | France | 294/70 |
| 13,821 | 1/1956 | Germany | 294/111 |
| 563,502 | 10/1932 | Germany | 294/70 |

*Primary Examiner*—Johnny D. Cherry

[57] ABSTRACT

A cable-controlled grab device possessing a pair of scoops directly and linkably connected to a support yoke. A central shaft has the scoops pivotably mounted at opposite ends thereof. An upper portion of tackle is secured to the yoke while between a lower portion thereof and the central shaft is arranged a releasable locking mechanism for indirectly connecting the scoops to the yoke. The locking mechanism has two locking arms urgeable by a remotely controllable actuating mechanism into a locking position in engagement with a locking member associated therewith. The actuating mechanism takes the form of a pressure medium cylinder linkably connected between the locking arms and inserted in a hydraulic circuit adapted to be pressure-loaded so as to force the locking arms into the locking position. A remotely controllable valve is included in the hydraulic circuit and is capable when closed of maintaining the arms in the locking position and when open of permitting the locking arms to slide out of engagement with the locking member due to the weight loading of the scoops.

5 Claims, 9 Drawing Figures

-FIG.1-

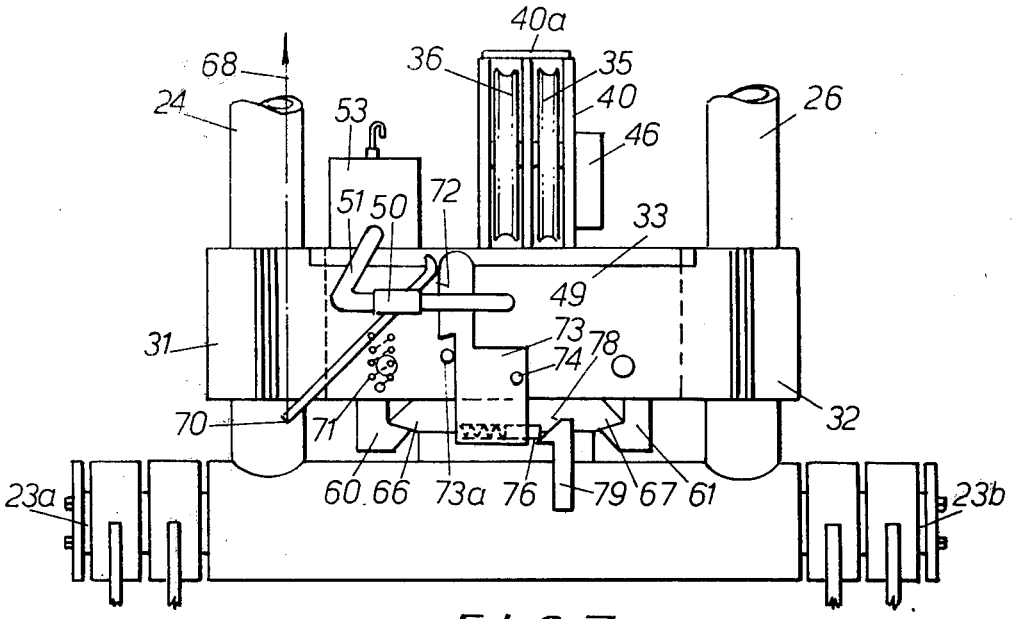
-FIG. 3-
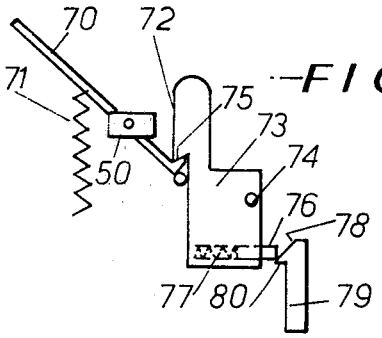
-FIG. 4-
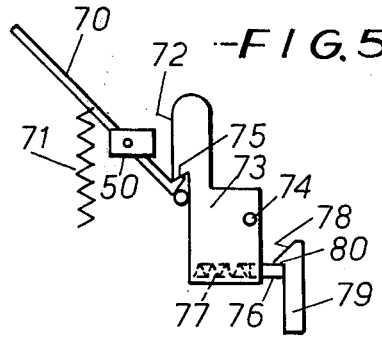
-FIG. 5-
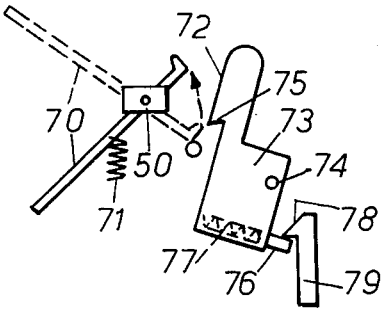
-FIG. 6-

-FIG. 7-
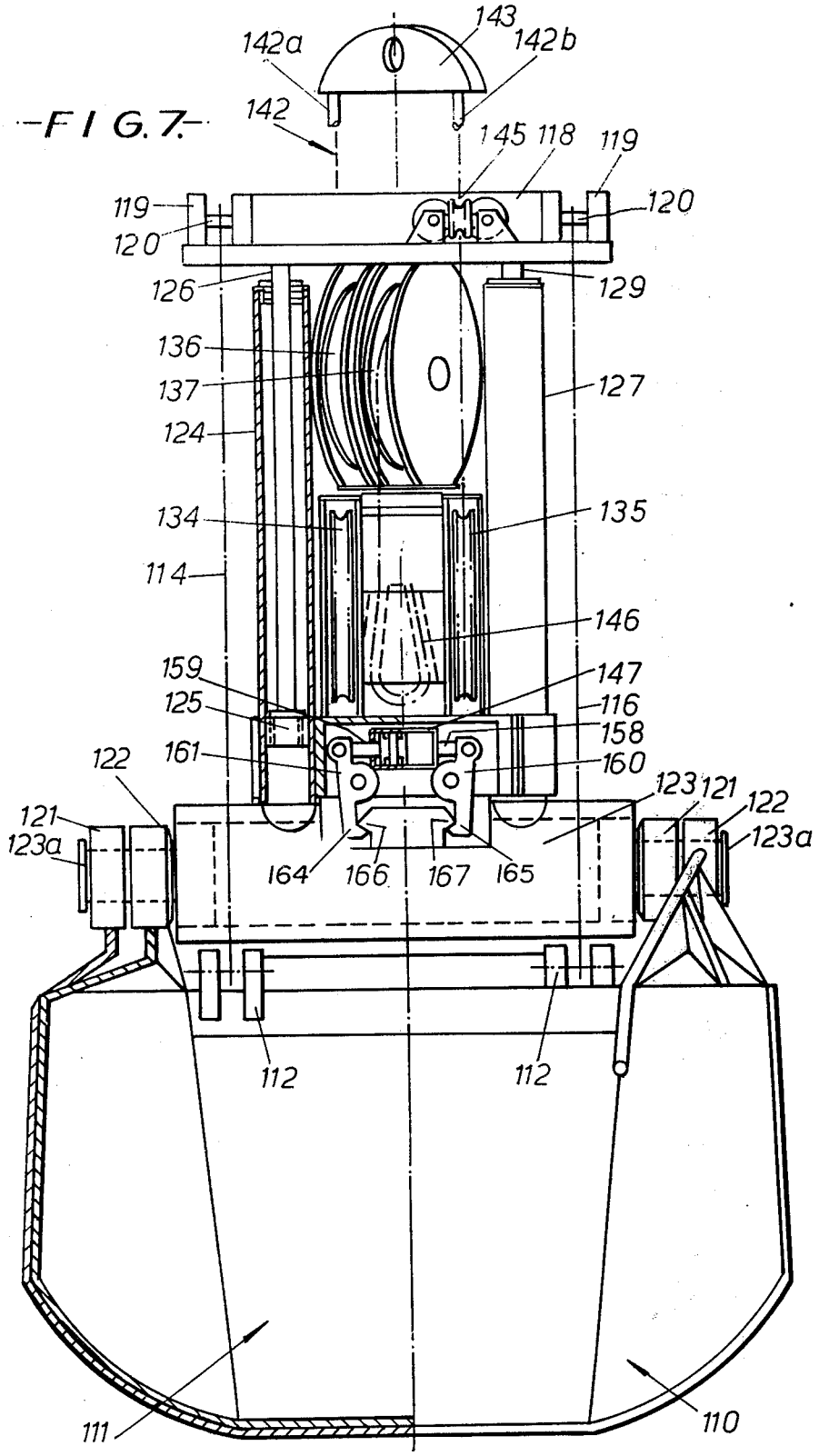

-FIG. 8-
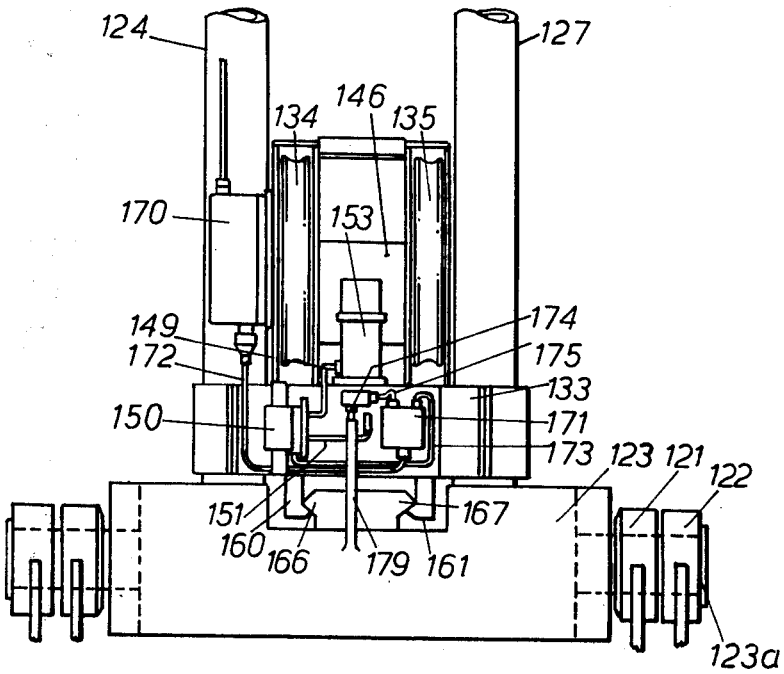
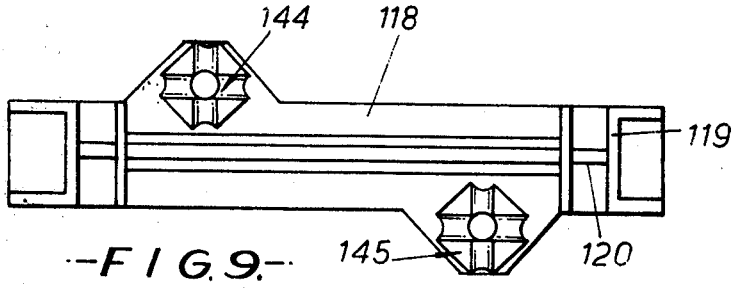
-FIG. 9-

CABLE-CONTROLLED GRAB DEVICE

This invention relates to cable-controlled grab devices.

Hitherto known locking devices for cable-controlled grabs are of relatively complicated construction, but nevertheless vulnerable to operative breakdown, since the releasing mechanism for the locking device in order to ensure against undesired release, demands large release forces and is exposed to heavy wear. The loss of time for repairs during operation involves extra high operation costs.

In German Patent Specification 563,502, there is disclosed a grab, the actuating portion of which is controlled by means of electric current. It appears to be necessary to have cable control forward to the actuation portion. In addition, the releasing mechanism of the locking arms is rather complicated.

An object of the present invention is to endeavour to avoid the afore-mentioned disadvantages by producing a device with a locking arrangement of a relatively simple and reliable construction, with minimal wear during use.

According to the present invention a cable-controlled grab device comprises a pair of scoops directly and linkably connected to support yoke means, a central shaft having said scoops pivotably mounted at opposite ends thereof, tackle means having an upper portion secured to said yoke means and releaseable locking means arranged between a lower portion thereof and said central shaft for indirectly connecting said scoops to said yoke means, said locking means comprising two locking arms urgeable by remotely controllable actuating means into a locking position in engagement with a locking member associated therewith, said actuating means being in the form of a pressure medium cylinder linkably connected between said locking arms and inserted in a hydraulic circuit adapted to be pressure-loaded so as to force said locking arms into said locking position, and said hydraulic circuit including remotely controllable valve means capable when closed of maintaining said arms in said locking position and when open of permitting said locking arms to slide out of engagement with said locking member due to the weight loading of said scoops.

By the proposal according to the invention, there is achieved an especially simple constructional solution. By utilising a static pressure in the hydraulic circuit to force the locking arms into place in the locking position in any situation when the valve in the hydraulic circuit is open, the placing of the locking arms in the locking position can be readily ensured. When the valve is closed, one can, on the other hand, be independent of the static pressure since the pressure loading which is exerted from the locking arms back towards the hydraulic circuit via the pressure medium cylinder is blocked by the valve in the hydraulic circuit. This means that one ensures the positioning of the locking arms in the locking position by means of the valve, that is to say without requiring a corresponding static counterpressure in the hydraulic pressure medium. In other words, one can utilise a hydraulic circuit with relatively moderate pressures. This means that by opening the grab, that is to say by opening a valve, one can ensure swinging of the scoops of the grab by means of the weight loading which is attained by means of the scoops of the grab.

The proposal according to the invention involves, furthermore, an additional advantageous constructional solution in that the pressure medium cylinder is directly link-connected to the locking arms. By this, the loading from the locking arms can be directly transferred to the pressure medium cylinder. The corresponding high pressure which is produced in the pressure medium can be limited to the restricted region of the hydraulic circuit which lies between the pressure medium cylinder and the valve.

In order that the invention can be more clearly understood, convenient embodiments thereof will now be described, by way of example, with reference to the accompanying drawings, in which:

FIG. 3 is an elevation of part of the grab of FIG. 1, showing the locking mechanism of the grab in a first position, FIG. 4, 5 and 6 show, in part, the locking mechanism of the grab of FIG. 3 in a second, third and fourth position.

FIG. 7 is a part-sectional end view of a grab of an alternative embodiment, with certain parts omitted for the sake of simplicity.

FIG. 8 is an elevation of part of the grab of FIG. 7 in which certain details which are excluded from FIG. 7 are shown in detail, and FIG. 9 is a plan of certain details of the embodiment of FIGS. 7 and 8.

Figure 1:
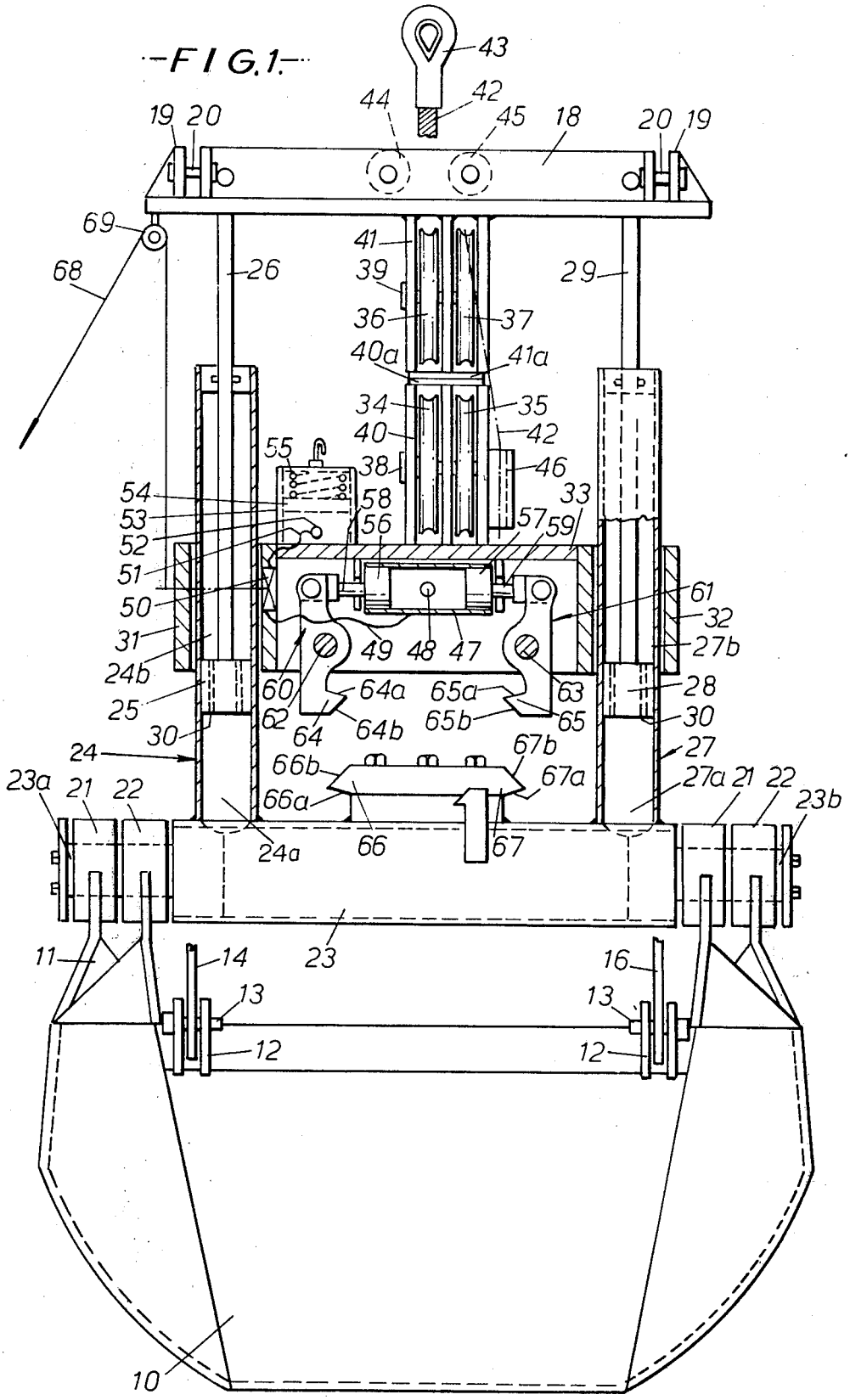
FIG. 1 is a part-sectional end view of a grab.

Referring to FIG. 1 - 6, the grab is provided with two scoops 10 and 11 which are connected at an upper outer edge via fastening lugs 12 and fastening pins 13 (FIG. 1 and 2) to the lower end of four cooperating link arms 14 - 17, the other end of which is connected to a common yoke 18 via fastening lugs 19 and fastening pins 20. The scoops 10, 11 of the grab are pivotably mounted at opposite ends 23*a* and 23*b* of a common shaft 23 by means of respective pairs of bearing sleeves 21, 22.

By raising or lowering the shaft 23 relative to the yoke 18, the scoops 10, 11 can be closed or opened in a known manner.

Between the yoke 18 an the shaft 23, there are inserted two piston cylinder arrangements 24-26 and 27-29 at a suitable distance from each other so that the platform and the shaft can be displaced accurately in a vertical direction relative to each other. The cylinders 24 and 27 of the arrangements are divided into separate chambers 24*a* and 24*b* and 27*a* and 27*b* respectively by means of a respective piston 25 and 28 which is connected to a respective piston rod 26 and 29. The pistons 25 and 28 are provided with their respective through flow passages 30 so that there can be obtained a certain, restricted flow of oil or another suitable medium via the passages 30 to and from the said chambers in order to procure thereby a subdued movement of the shaft 23 relatively to the yoke especially on opening the grab. The piston-cylinder arrangements 24-26 and 27-29 can serve thereby as shock dampers for the scoops during opening of the grab, in addition to controlling the shaft 23 in an accurately vertically displaced manner relative to the yoke 18.

The cylinders 24 and 26 form with their outer surfaces external guides for respective guide sleeves 31, 32 on a slide piece 33. Between the slide piece 33 and the yoke 18, there is arranged a four notched tackle comprising two guide pulleys 34, 35 fixed to the top of the slide piece 33 and two guide pulleys 36, 37 fixed to the under side of the yoke 18, rotatably mounted on respective support pins 38 and 39 through respective brackets 40 and 41. A cable-controlled wire 42 extends from a fastening eye 43 downwards between two control wheels 44, 45 on the yoke and further, via guide pulleys 34-37, to a fastening 46 on the bracket 40 on the slide piece 33. The brackets 40 and 41 form abutments against each other in the position which is shown in FIG. 1, via plate pieces 40*a* and 41*a*. In this position, the scoops of the grab are shown in an intermediate position (FIG. 2) during the introductory outward swinging of the scoops for opening of the grab, that is to say after the slide piece 33 is released from the shaft 23 from the locking position which is shown in FIG. 3.

In the slide piece 33, there is secured a pressure oil cylinder 47 having an oil passage connection from a central union 48, via a duct 51, to a union 52 in an expansion tank 53 which is arranged on the top of the slide piece 33. In the expansion tank 53, there is exerted a pressure against the oil in the cylinder 47 from a piston 54, via a compression spring 55, arranged at the rear of the piston.

In the cylinder 47, there is received on opposite sides of the central union 48, a pair of reversely operating pistons 56, 57 each having an associated piston rod 58, 59 which, via a joint point, are connected to their respective locking means 60, 61. The locking means are rotatably mounted at the central portion of a bearing pin 62, 63 and support, at the free-ending branch, locking hooks 64, 65 directed mutually towards each other which are adapted to cooperate with a pair of locking portions 66, 67 which are formed into a unitary piece and which are secured to the shaft 23. An oblique downwardly extending locking surface 64*a* on the locking hook 64 is adapted in the locking position (FIG. 3) to bear against an oblique upwardly extending locking surface 66*a* on the locking portion 66, while a corresponding oblique downwardly extending locking surface 65*a* on the locking hook 65 is similarly adapted to bear against on oblique upwardly extending locking surface 67*a* on the locking portion 67. The locking hooks 64 and 65 are provided with mutually equivalent, obliquely extending slide surfaces 64*b* and 65*b* which cooperate with corresponding slide surfaces 66*b* and 67*b* on the locking portions 66 and 67. The said obliquely extending surfaces are to permit intentional swinging of the locking means 60, 61 during displacement of the locking portions inwardly into or outwardly from the locking means during the vertical displacement of the slide piece relative to the shaft 23.

The valve 50, which in the open position permits free swinging of the locking hooks 64, 65 and in the closed position locks the locking hooks 64, 65 in a desired locking position, is actuated by remote control by the pull in a pulling line 68. The pulling line extends, as shown in FIG. 1, via a guide roll 69 on the yoke to the outer end of an actuating arm 70 which is pivotably mounted on the slide piece and is directly, swingably connected to the valve body of the valve 50. A tension springs 71 retains the arm 70 normally in place in the released position which is shown in FIG. 3, the valve in this position being closed. In this position, the free end of the arm 70 forms, in addition, an abutment against a slide surface 72 on a stop member 73 which is pivotably mounted on a pivot pin 74 on the slide piece 33 with a stop abutment against a stop boss 73*a*. In FIG. 4, the arm 70 is shown in a locked position behind a shoulder portion 75 on the stop member 73, after the arm 70 has been swung against the force of the spring 71 by pulling the pulling line 68, and the valve 50 is placed in the open position.

The stop member 73 is provided with an axially displaceable pin 76 mounted at the lower edge of the stop member which is pressure loaded in a direction outwardly of the stop member by means of a compression spring 77. In FIG. 4, the pin 76 is directed against an obliquely extending slide surface 78 on a locking hook 79. In FIG. 5, the pin 76 has been pushed in below a shoulder portion 80 on the locking hook due to the slide piece 33 being guided wholly down into abutment with the shaft 23. After the slide piece is raised upwards again from the shaft 23, the stop member 73 is swung as indicated in FIG. 6 so that the arm 70 is released and is swung back to the starting position as shown in FIG. 3. In this way, the valve 50 is closed again and by further raising of the slide piece the locking surfaces 64*a*, 65*a* are led into abutment with the locking surfaces 66*a* and 67*a*, without the possibility of the locking means 60, 61 being pivoted without actuation via the pulling line 68.

In the following description the mode of operation of the grab will be disclosed.

1. In the starting position the grab is suspended with total weight loading in the wire 42 and the scoops are closed. The locking means 64, 65 are in locking engagement with the locking portions 66, 67 as shown in FIG. 3. The shaft 23 is supported, via the locking means and the locking portions of the slide piece 33, with a definite clearance between the bracket surfaces 40*a*, 41*a*.

The valve 50 is closed and the arm 70 and the stop 73 assume the starting position as is shown in FIG. 3.

Figure 2:
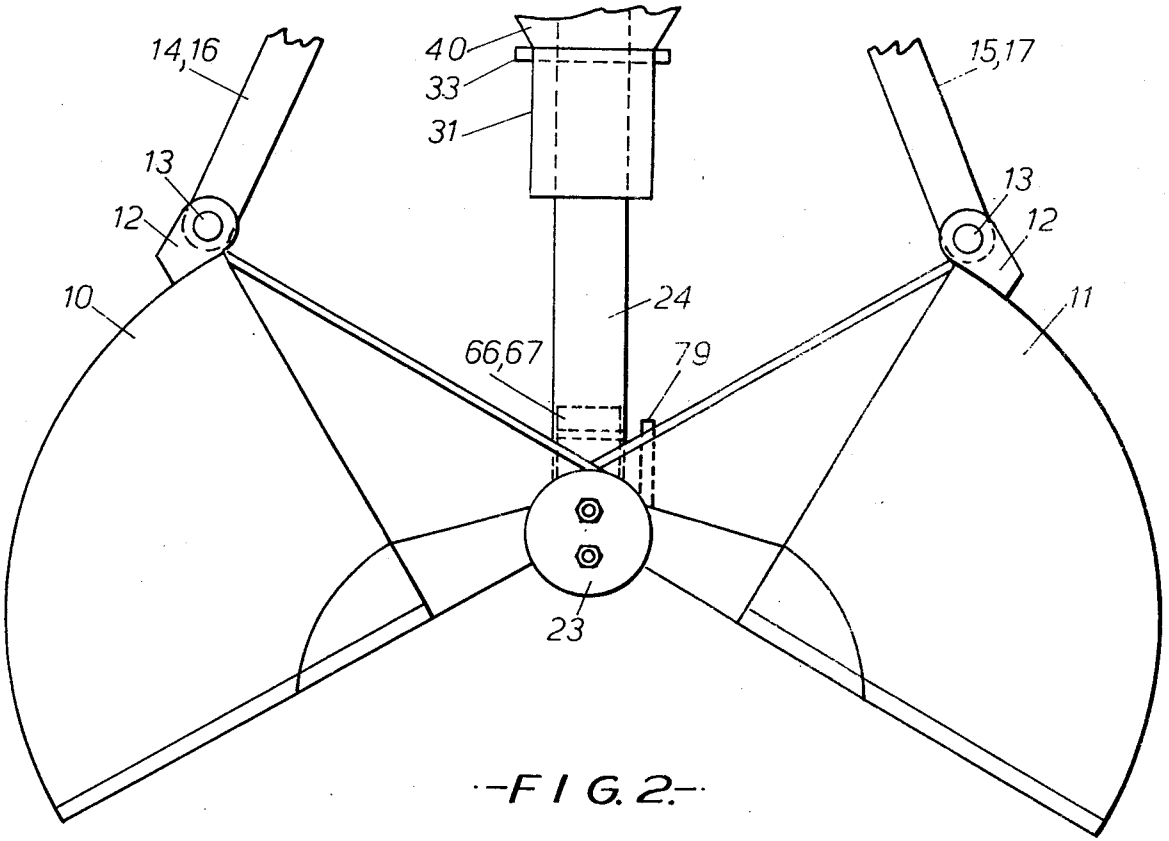
FIG. 2 is a side elevation of a part of the lower portion of the grab of FIG. 1.

2. The scoops of the grab are brought to the open position by a pull in the line 68 so that the arm 70 assumes the position which is shown in FIG. 4, whereby the valve 50 is open and is held in the open position and thereby releases the locking means for swinging. In FIG. 1 the grab is shown in an intermediate position just after the locking means are released from the locking portions and with the shaft 23 on the way downwards relative to the slide piece 33, adjusted to a suitable braking speed by means of the piston-cylinder arrangements 24-26 and 27-29. The tackle assumes the same position as shown in FIG. 1, the weight loading of the grab being transferred via the bracket surfaces 40*a* and 41*a* to the wire 42, even in the fully open position of the grab, as indicated in FIG. 2.

3. (a) The open scoops are set on the ground so as to make ready for filling with charge. After this the wire 42 is slackened and the slide piece 33 is released thereby relative to the yoke and slides downwards along the guides on the cylinders 24, 26 until the slide surfaces 64*b*, 65*b*, 66*b*, 67*b* tough each other. The locking means 60, 61 can be freely swung relative to the locking portions 66, 67 so that the locking means can pass by the locking portions 66, 67 and be brought into locking engagement with the latter. In this way, the pin 76 slides along the slide surface 78 and passes finally by means of the force of compression spring 77 into place below the shoulder portion 80 of the locking hook 79 as shown in FIG. 5. The scoops are now set ready against the ground and are clear for filling.

b. The filling operation itself takes place thereafter by drawing in the wire 42, whereby the slide piece 33 is raised upwardly from the shaft 23. The pin 76 is locked by the shoulder portion 80 of the locking hook 79 and entails the swinging of the stop member 73 as indicated in FIG. 6 and thereby the release of the arm 70. By means of the force from the tension spring 71, the arm 70 is led back to the starting position, as shown in FIG. 3, so that the valve 50 is brought into the closed position and thereby prevents further swinging of the locking means 60, 61 relative to the locking portions. By further raising of the slide piece, the pin 76 will pass by the shoulder portion 80 and dispose itself against the slide surface 78 of the locking hook 79, as is shown in FIG. 3, while the locking surfaces 64*a*, 65*a*, 66*a*, 67*a* are brought in pairs into engagement with each other. The locking means 60, 61 are prevented from being swung as a consequence of the closed valve 50.

4. On further lifting of the slide piece 33 via the wire 42, the jaw surfaces of the scoops are finally brought into mutual abutment. The scoops are gradually closed and the weight of the grab is transferred, via the slide piece 33, to the wire 42 so that the grab can hang in the closed condition with the full weight loading in the wire 42 as described under point 1 above, and can be transported to a desired emptying location and the cycle repeated with emptying of charge correspondingly as described under point 2 above.

In FIG. 7–9, there is illustrated an alternative form of the grab according to FIG. 1–6, where similar parts are denoted by a reference numeral which is one hundred larger than the reference numeral of FIG. 1–6.

A first modification consists in replacing the single running wire 42 of FIG. 1 with a two part wire 142. The wire 142 is thus secured at the centre, via clamp pieces and clamp screws (not shown) to a fastening eye-forming support piece 143 from which two parts 142*a* and 142*b* of the wire pass individually through the yoke 118 on respective sides of the latter via respective fair lead 144 or 145. The part 142*a* extends (on the rear side of the yoke 118 in FIG. 7) downwards to the castor 134 which is fixed to the slide piece 133 and around this upwards to the castor 136 on the yoke 118 and from this to a fastening point 146 on the slide piece. The part 142*b* extends similarly (on the front side of the yoke 118 in FIG. 7) via the castor 135 on the slide piece 133 and via the castor 137 on the yoke 118 to the fastening point 146 on the slide piece 133. The loading on the parts 142*a*, 142*b* is, according to FIG. 7, only half the loading on the wire 42 according to FIG. 1 and the length of movement of the support piece 143 according to FIG. 7 on swinging of the grab from the open to the closed position, and the reverse, is only a half as large as for the fastening eye 43 according to FIG. 1. Simultaneously, there is obtained a stabilisation of the grab via the support piece 143 and the two associated wire parts 142*a*, 142*b*. For one thing, turning of the gab about a vertical axis can be counteracted, such as can occur on using the wire 42 according to FIG. 1, where the grab is turned about the vertical single running part of the wire 42.

It is evident from FIG. 7 that the lower castors 134, 135 are pushed laterally outwards from each other so that their plane aligns with the wire parts 142*a* and 142*b*, and are arranged on each side of the fastening point 146. The castors 136, 137 are obliquely disposed about 45° relative to the plane of the castors 134, 135 so that the wire parts extend separately, substantially vertically, between the lower castor and the associated upper castor and substantially vertically between the upper castor and the associated fastening point 146.

In FIG. 9, there are shown the said fair leads 144 and 145 secured to the yoke 118 so that the wire parts receive a substantially vertical path between the support piece 143 and the associated castor 134 or 135. Each fair lead consists of four castors with concave grooves which together define a substantially circular gap between the castors.

The double-acting pressure medium cylinder 47 according to FIG. 1 is replaced in the construction according to FIG. 7 by a single-acting pressure medium cylinder 147. The cylinder 147 is secured via a support strap 158 to the one locking means 160, while its piston rod 159 is secured to the other locking means 161.

The mechanical releasing mechanism which is shown in FIGS. 1 and 3–6 is replaced in the embodiment of FIG. 8 by a radio-controlled releasing mechanism.

The pressure medium cylinder 147 is supplied with pressure oil from an expansion tank 153 via a magneto-valve 150 in a conduit connection 149, 151. The valve 150 opens the connection between the tank 153 and the cylinder 147 by means of a radio signal which is transferred to a battery-driven receiver 170 on the slide piece 133. The receiver 170 is connected to the magneto-valve 150 via a coupling box 171 in a conduit connection 172, 173. The magneto-valve 150 is closed by means of an end switch 174 which is connected to the valve 150 via the coupling box 171 by means of a conduit connection 175, 173. The end switch 174 is actuated by a rod 179 fixed to the scoop shaft 123.

The mode of operation of the grab according to FIGS. 7–9 is substantially similar to that which is described for the embodiment according to FIGS. 1–6, that is to say:

1. It is started in a position where the grab hangs with full weight loading in the wire 142 in the swung-together, closed condition of the grab, as is shown in FIG. 7, the weight of the grab with contents being transferred from the scoop shaft 123 via an active locking mechanism 160, 161, 166, 167 to the slide piece 133 and from the slide piece via the wire 142 and the castors 134, 135, 136, 137 to the support piece 143.

2. A radio signal is transmitted to the receiver 170 which actuates, via the coupling box 171, the magneto-valve 150 to the open position. This means that the weight loading from the scoop shaft 123 of the grab, via the associated locking portions 166, 167, towards the swingable locking means 160, 161 can be relieved through the pressure medium in the cylinder 147 due to the pressure medium being pressed via the valve 150 into the expansion tank 153. The lower locking portions 164, 165 of the locking means can, in this way, be swung outwardly from each other and can release the locking portions 166, 167 on the scoop shaft. Immediately after the locking portions 166, 167 are released, the locking portions can be swung into place in the starting position by means of the pressure medium in the expansion tank 153. The scoop shaft 123 is permitted, in consequence, to sink downwards relative to the slide piece 133 and the yoke 118 since the weight of the grab is now transferred, via the yoke 118, to the wire 142, while the slide piece 133 is held against the yoke 118 via the wire parts 142*a*, 142*b* and the associated castors 134, 136 and 135, 137. The grab is swung until it assumes the fully open position, (such as shown in the first embodiment in FIG. 2).

3. On making the grab ready for loading the latter is lowered to land on the ground in the fully open position. In connection with landing on the ground, the wire 142 is slackened so that the slide piece is lowered downwardly towards the scoop shaft 123 and the locking portions 166, 167 are urged as a consequence of the weight of the slide piece and associated parts inwardly between locking portions 164, 165 of the locking means, after which the pressure in the expansion tank 153 forces the locking portions 164, 165 anew into place in the closed position which is shown in FIG. 7. Gradually as the slide piece is lowered further downwardly towards the scoop shaft, the rod 179 is brought into abutment with the end switch 174, whereby the end switch actuates the magnetovalve 150 and brings the latter to the closed position and thereby blocks the locking portions 164, 165 relative to the locking portions 166, 167.

4. By pulling the wire 142, the slide piece 133 and the scoop shaft 123 are raised upwards towards the yoke 118 at the same time that the scoops 110, 111 are forced together against each other in the closed position. The raising of the slide piece with the scoop shaft is made possible as a consequence of the blocking of the locking portions in the locked position.

5. By raising the grab via the wire 142, the grab is held in the closed position until a radio signal is transmitted to the receiver 170 on the grab, as is indicated under point 2 above.

What we claim is:

1. In a cable-controlled grab device which comprises support yoke means, a pair of scoops directly and linkably connected to said yoke means, a central shaft having said scoops pivotably mounted at opposite ends thereof, tackle means having upper and lower portions, said upper portion being secured to said yoke means and releaseable locking means arranged between said lower portion and said central shaft for indirectly connecting said scoops to said yoke means, said locking means comprising two locking arms urgeable by remotely controllable actuating means into a locking position in engagement with a locking member associated therewith, the improvement consisting in actuating means in the form of a pressure medium cylinder linkably connected between said locking arms and inserted in a hydraulic circuit adapted to be pressure-loaded so as to force said locking arms into said locking position, remotely controllable valve means in said hydraulic circuit capable when closed of maintaining said arms in said locking position and when open of permitting said locking arms to slide out of engagement with said locking member due to the weight loading of said scoops.

2. The device of claim 1, wherein the pressure medium cylinder has pistons directly forming the linkable connection with the locking arms.

3. The device of claim 1, wherein components of said hydraulic circuit and said locking arms are arranged on said lower portion of said tackle means while said locking member is mounted on said shaft.

4. The device of claim 1, wherein said valve means is fixed to said lower portion of said tackle means and is adapted to be closed by the actuation of means projecting upwardly from said shaft.

5. The device of claim 1, wherein said shaft is connected to said yoke means by two cylinder means having pistons with internal flow passages adapted to ensure a dampened movement thereof while cylinders of said cylinder means form external guides for said lower portion of said tackle means.

* * * * *